US007191739B1

(12) United States Patent
Klop et al.

(10) Patent No.: US 7,191,739 B1
(45) Date of Patent: Mar. 20, 2007

(54) INTEGRAL COOLANT RESERVOIR AND AIR CLEANER FOR AUTOMOTIVE VEHICLE

(75) Inventors: Aaron Peter Klop, Birmingham, MI (US); Larry Dupuis, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/164,809

(22) Filed: Dec. 6, 2005

(51) Int. Cl.
*F01P 3/22* (2006.01)
*F02B 77/04* (2006.01)

(52) U.S. Cl. ..... 123/41.54; 123/198 E

(58) Field of Classification Search ..... 123/41.54, 123/198 E; 165/104.32
See application file for complete search history.

(56) References Cited

U.S. PATENT DOCUMENTS

| | | | |
|---|---|---|---|
| 4,976,327 | A | 12/1990 | Abujudom, II et al. |
| 6,230,833 | B1 | 5/2001 | Setsuda |
| 6,247,442 | B1 | 6/2001 | Bedard et al. |
| 6,439,329 | B1 | 8/2002 | Vaishnav et al. |
| 2003/0080271 | A1 | 5/2003 | Haves |

FOREIGN PATENT DOCUMENTS

JP 53056417 A * 5/1978

* cited by examiner

*Primary Examiner*—Noah P. Kamen
(74) *Attorney, Agent, or Firm*—Gigette M. Bejin; Artz & Artz, P.C.

(57) ABSTRACT

In integral utility assembly for an automotive vehicle includes a coolant reservoir and an air cleaner. A mounting bracket for attaching the assembly to an engine compartment structure is co-molded with an air cleaner base and a lower portion of a coolant reservoir, so as to form an assembly having strength required for mounting with a single mounting plate.

20 Claims, 3 Drawing Sheets

INTEGRAL COOLANT RESERVOIR AND AIR CLEANER FOR AUTOMOTIVE VEHICLE

TECHNICAL FIELD

1. Description

The present invention relates to a combination air cleaner and coolant reservoir suitable for mounting within the engine compartment of a motor vehicle.

2. Background

Automotive designers have attempted to combine several utilities in the underhood environment of automotive vehicles. These efforts have met with varying success. U.S. Publication 2003/0080271 discloses a combined utility including two reservoirs and electronic components. The design presented in the '271 application presents an opportunity for further integration in terms of the packaging of its various elements.

U.S. Pat. No. 4,976,327 discloses a combined battery and air cleaner housing for use in a vehicle which, too, is not package efficient because the air cleaner housing extends a considerable distance from the mounting point of the unit, which is located behind the vehicle battery.

U.S. Pat. No. 6,247,442 discloses another combination design for a coolant reservoir, an air cleaner, and an oil tank which suffers from a less than optimal mounting arrangement in which the air cleaner portion of the device, as well as lower portions of the oil tank and coolant reservoir are cantilevered from the upper portion of the oil tank and coolant reservoir. This device, although apparently suitable for use in a snowmobile, is of doubtful utility for use in wheeled passenger vehicles, given the difficult operating environments to which such vehicles are subjected, coupled with extended operational life requirements.

An integral coolant reservoir and air cleaner for an automotive vehicle according to the present invention solves the problems associated with prior art devices by providing a compact, rugged utility which is easily mounted within an engine compartment of a motor vehicle.

SUMMARY

An integral assembly, having a coolant reservoir and an air cleaner for an automotive vehicle, includes a mounting bracket for attaching the integral assembly to an engine compartment structure of a vehicle, as well as an air cleaner base formed integrally with the mounting bracket. The air cleaner base has a plurality of sidewalls and a floor extending from the mounting bracket, such that the mounting bracket comprises one wall of the air cleaner base. A coolant reservoir has a lower portion formed integrally with the mounting bracket and supported by the mounting bracket, as well as by one of the sidewalls of the air cleaner base. Thus, the coolant reservoir has triangulated support.

The coolant reservoir included in the present integral assembly further includes an upper portion attached to the lower portion of the reservoir. A number of reinforcing ribs extend from the lower portion of the coolant reservoir to the air cleaner sidewall supporting the coolant reservoir. A second group of reinforcing ribs extends from the lower portion of the coolant reservoir to the mounting bracket. The mounting bracket preferably includes an outer wall backed by a plurality of reinforcing ribs.

The present assembly further includes an air cleaner cover which is removably attached to the air cleaner base. An air inlet is provided by virtue of an air inlet horn extending through the mounting bracket and into the interior of the air cleaner base. An air outlet is formed integrally with the air cleaner cover and may include an air flow meter mounted within the air outlet. An air filter element is positioned within the air cleaner between the air cleaner base and the cover.

The present air cleaner and coolant reservoir provides the advantage of an efficient overall package space, which is ideally adapted for use within a crowded automotive engine compartment.

The present system provides the additional advantage that fewer parts, and therefore, reduced complexity are needed to apply a combined air cleaner and coolant reservoir across a wide range of vehicles. This capability is promoted, for example, by the use of a detachable air inlet horn.

Other advantages and features of the present invention will become apparent when viewed in light of the detailed description of the preferred embodiments when taken in conjunction with the attached drawings and appended claims.

DETAILED DESCRIPTION OF THE PREFERRED EMBODIMENTS

Figure 1:
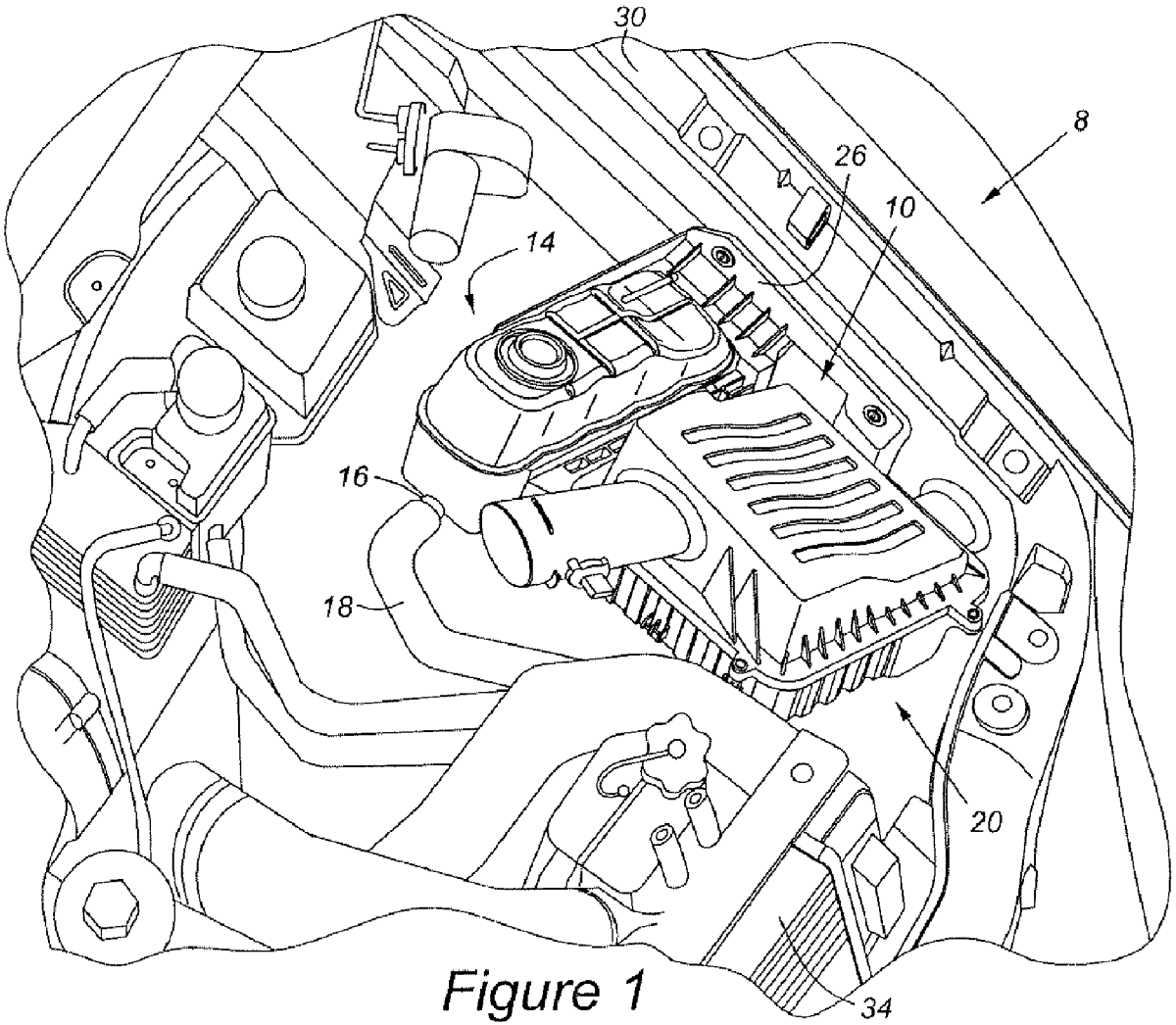
FIG. 1 is perspective view of an engine compartment having an integral coolant reservoir and air cleaner according to the present invention.

As shown in FIG. 1, vehicle 8 has an integral assembly 10 which is attached to fender apron 30 by means of mounting bracket 26. Assembly 10 includes air cleaner 20, and engine coolant reservoir 14, which provides coolant via outlet 16 and hose 18 to radiator 34. As shown in FIG. 1, mounting bracket 26 extends across the entirety and beyond the extent of engine coolant reservoir 14; bracket 26 also extends for at least one-half of the length of air cleaner 20, as well. In this manner, mounting bracket 26 provides excellent support for assembly 10.

Figure 3:
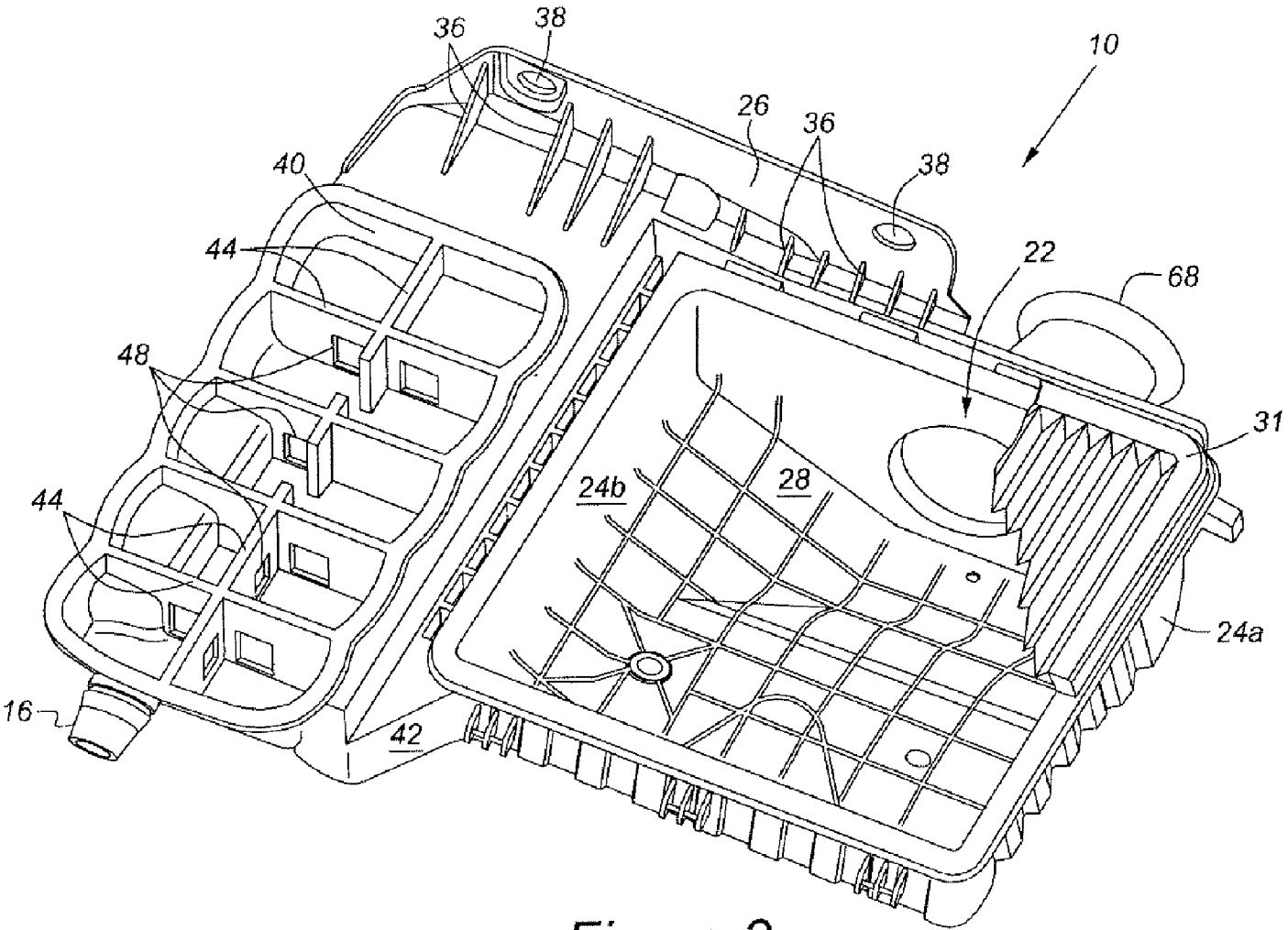
FIG. 3 is a perspective view of a molded bracket, air cleaner base, and coolant reservoir lower portion according to the present invention.

As shown in FIG. 3, mounting holes 38 are formed in mounting bracket 26 to provide for the passage of fasteners (not shown) into either fender apron 30, or into any other suitable mounting structure in the vehicle engine compartment. A plurality of ribs, 36, is provided between bracket 26, and the lower portion, 40, of coolant reservoir 14, as well as between bracket 26 and air cleaner base 26, so as to strengthen the entirety of assembly 10 and to allow assembly 10 to be mounted primarily, if not solely by means of mounting bracket 26. Lower coolant reservoir 40 is also mounted to sidewall **24*b* of air cleaner base 22, and strengthened by ribs 42 extending from sidewall 24*b***, for additional structural integrity.

The strength of lower portion 40 of coolant reservoir 14 is buttressed by means of a plurality of reinforcing ribs, 44, applied within lower portion 40. Ribs 44 are ported by means of ports 46 to allow coolant to flow freely through the entirety of lower portion 40 of reservoir 14.

Air cleaner base 22 has floor 28, which is contoured so as to allow the obstruction-free passage of air through inlet horn 68, which extends through mounting bracket 26 and into the interior of air cleaner 20 under element 31.

Figure 2:
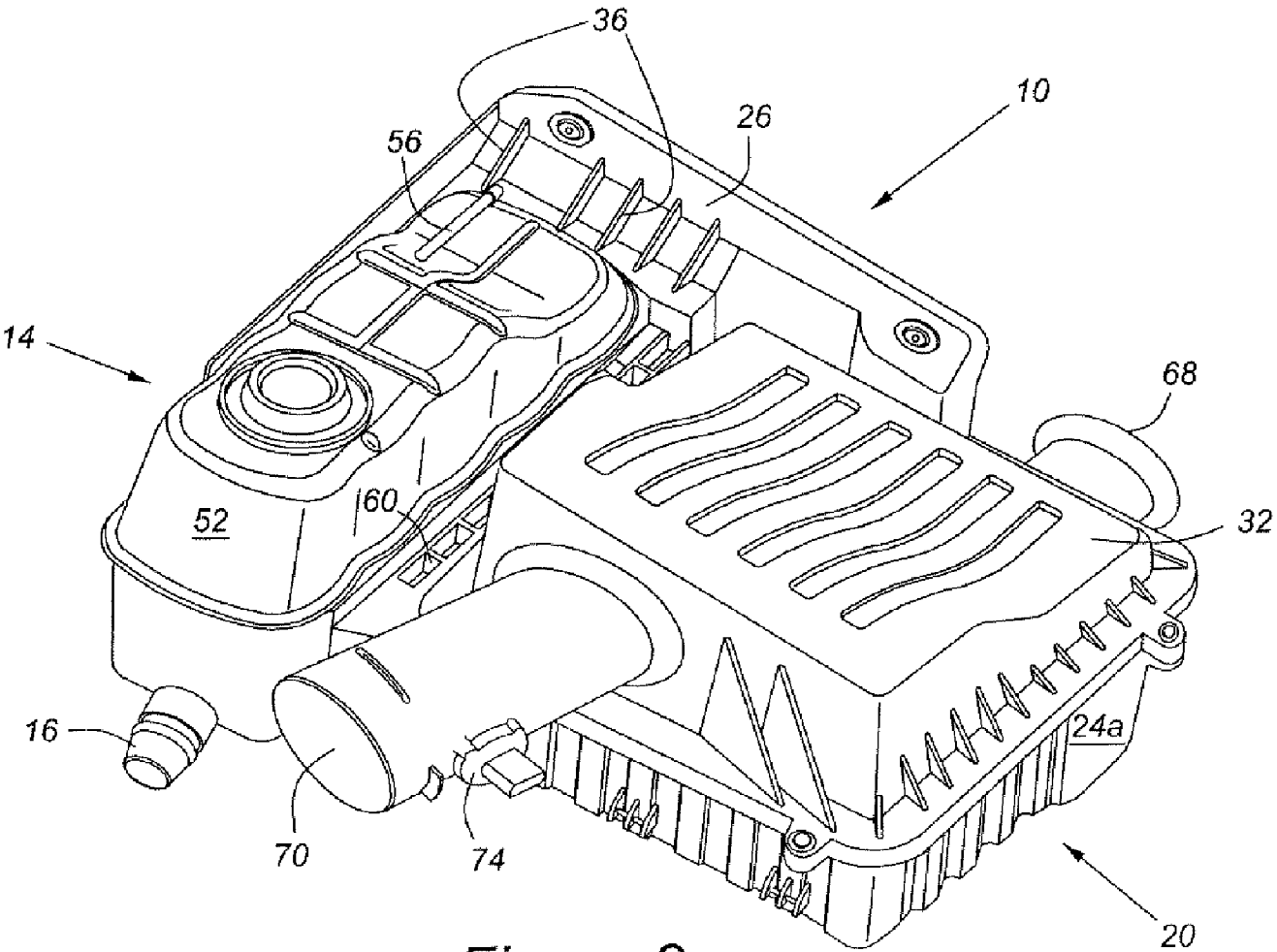
FIG. 2 is a perspective view of a unit illustrated in FIG. 1.

As shown in FIGS. 1 and 2, air cleaner 20 further includes cover 32 which has air outlet 70 formed therein. Outlet 70 carries air meter 74. Cover 32, which is preferably made from molded plastic such as polyamide, can be attached by means of threaded fasteners, clips, or other removable fasteners known to those skilled in the art and suggested by this disclosure.

The portion of the present integral assembly comprising mounting bracket 26, air cleaner base 22, and coolant reservoir lower portion 40 is preferably molded from polypropylene, and more preferably, glass filled polypropylene having a glass content in the range of 25 to 35 percent. Upper portion 52 of coolant reservoir 14 is also preferably constructed of polypropylene, to allow welding of upper portion 52 to lower portion 40 of reservoir 14.

While particular embodiments of the invention have been shown and described, numerous variations and alternate embodiments will occur to those skilled in the art. Accordingly, it is intended that the invention be limited only in terms of the appended claims.

What is claimed is:

1. An integral assembly having a coolant reservoir and an air cleaner for an automotive vehicle, comprising:

a mounting bracket for attaching said integral assembly to an engine compartment structure of an automotive vehicle;

an air cleaner base formed integrally with said mounting bracket, with said air cleaner base having a plurality of sidewalls and a floor extending from said mounting bracket such that said mounting bracket comprises one wall of said air cleaner base;

a coolant reservoir having a lower portion formed integrally with said mounting bracket, and with said lower portion being supported by said mounting bracket and by one of said sidewalls of said air cleaner base.

2. An integral assembly according to claim 1, further comprising an upper portion of said coolant reservoir which is attached to said lower portion of said coolant reservoir.

3. An integral assembly according to claim 2, wherein said upper portion of said coolant reservoir comprises unfilled molded polypropylene.

4. An integral assembly according to claim 3, wherein said upper portion of said coolant reservoir is welded to said lower portion of said coolant reservoir.

5. An integral assembly according to claim 1, further comprising a plurality of reinforcing ribs extending from said lower portion of said coolant reservoir to the sidewall supporting said coolant reservoir.

6. An integral assembly according to claim 1, further comprising a plurality of reinforcing ribs extending from said lower portion of said coolant reservoir to said mounting bracket.

7. An integral assembly according to claim 1, wherein said mounting bracket comprises an outer wall backed by a plurality of reinforcing ribs.

8. An integral assembly according to claim 1, wherein said integral assembly is molded from polypropylene.

9. An integral assembly according to claim 1, wherein said integral assembly is molded from glass-filled polypropylene.

10. An integral assembly according to claim 1, further comprising an air cleaner cover which is removably attached to said air cleaner base, and with said air cleaner cover having at least one air outlet.

11. An integral assembly according to claim 10, wherein said upper portion of said air cleaner is formed from polyamide.

12. An integral assembly according to claim 1, wherein said lower portion of said coolant reservoir has at least one fluid connector.

13. An integral assembly according to claim 1, further comprising an air inlet horn extending through said mounting bracket to the interior of said air cleaner base.

14. An integral assembly according to claim 13, wherein said air inlet horn is detachable from said air cleaner base.

15. An integral assembly according to claim 1, further comprising a plurality of ported reinforcing ribs extending through said lower portion of said coolant reservoir.

16. An assembly having an engine coolant reservoir and an air cleaner for an automotive vehicle, comprising:

a base structure comprising:

an integral mounting bracket for attaching said assembly to an engine compartment structure of an automotive vehicle;

an air cleaner having a base molded integrally with said mounting bracket, with said air cleaner base having a plurality of sidewalls and a floor extending from said mounting bracket such that said mounting bracket comprises an additional wall of said air cleaner;

an engine coolant reservoir having a lower portion molded integrally with said mounting bracket and with said air cleaner base, and with said lower portion of said coolant reservoir being supported by said mounting bracket and by one of said sidewalls of said air cleaner;

a cover which is removably attached to said air cleaner base;

an air filter element positioned within said air cleaner between said air cleaner base and said cover;

an air inlet horn extending through said mounting bracket and into a portion of said air cleaner base underlying said filter element;

an air outlet extending from said air cleaner cover;

an air flow meter mounted within said air outlet; and a coolant reservoir upper portion attached to said lower portion of said coolant reservoir.

17. An assembly according to claim 16, wherein said assembly is molded from glass-filled polypropylene.

18. An assembly according to claim 17, wherein said polypropylene is filled with glass in a range of 25–35 percent.

19. An assembly according to claim 16, wherein said air inlet horn is removable from said air cleaner base.

20. An automotive vehicle, comprising:

an engine compartment;

an engine cooling radiator mounted within said engine compartment;

an integral coolant reservoir and air cleaner base structure comprising:

an integral mounting bracket for attaching said base structure to a mounting structure within said engine compartment;

an air cleaner having a base molded integrally with said mounting bracket, with said air cleaner base having a plurality of sidewalls and a floor extending from said mounting bracket such that said mounting bracket comprises an additional wall of said air cleaner; and an engine coolant reservoir having a lower portion molded integrally with said mounting bracket and with said air cleaner base, and with said lower portion of said coolant reservoir being supported by said mounting bracket and by one of said sidewalls of said air cleaner;

a cover which is removably attached to said air cleaner base;

an air filter element positioned within said air cleaner between said air cleaner base and said cover;

an air inlet horn extending through said mounting bracket and into a portion of said air cleaner base underlying said filter element;

an air outlet extending from said air cleaner cover;

an air flow meter mounted within said air outlet; and a coolant reservoir upper portion attached to said lower portion of said coolant reservoir.

* * * * *